US007553224B2

(12) United States Patent
Choi et al.

(10) Patent No.: US 7,553,224 B2
(45) Date of Patent: Jun. 30, 2009

(54) COIN SORTING APPARATUS AND OPERATION METHOD OF THE SAME

(75) Inventors: Hun Choi, Incheon-si (KR); Dae Seung Woo, Incheon-si (KR); Han Sung Park, Seoul (KR); Un Ki Kim, Incheon-si (KR)

(73) Assignee: Royal Sovereign, Inc., Incheon-Si (KR)

( * ) Notice: Subject to any disclaimer, the term of this patent is extended or adjusted under 35 U.S.C. 154(b) by 517 days.

(21) Appl. No.: 10/961,893

(22) Filed: Oct. 7, 2004

(65) Prior Publication Data

US 2006/0070841 A1 Apr. 6, 2006

(30) Foreign Application Priority Data

Sep. 24, 2004 (KR) ..... 10-2004-0077252

(51) Int. Cl.
*G07D 9/00* (2006.01)

(52) U.S. Cl. ..... 453/61; 453/6; 453/13; 453/49; 453/57; 194/334; 194/338

(58) Field of Classification Search ..... 221/72; 453/16, 17, 6, 13, 49, 57, 61, 62; 74/395–397; 194/334, 335, 338
See application file for complete search history.

(56) References Cited

U.S. PATENT DOCUMENTS

| | | | | |
|---|---|---|---|---|
| 4,881,918 | A * | 11/1989 | Goh et al. | 453/4 |
| 4,893,706 | A * | 1/1990 | Ibarrola | 194/346 |
| 6,371,845 | B1 * | 4/2002 | Ishida et al. | 453/17 |
| 7,225,697 | B2 * | 6/2007 | Schalk et al. | 74/405 |
| 2004/0040820 | A1 * | 3/2004 | Adams et al. | 194/216 |

* cited by examiner

*Primary Examiner*—Jeffrey A Shapiro
(74) *Attorney, Agent, or Firm*—Saliwanchik, Lloyd & Saliwanchik

(57) ABSTRACT

A coin sorting apparatus is provided. The coin sorting apparatus includes a coin separating unit for separating coins depending on kinds of the coins, and a coin receiving unit. The coin receiving unit continues to automatically operate until a plurality of coin receiving tubs are all full. Therefore, the number of coins that can be separated by one-time operation is increased, thereby improving a user's convenience.

10 Claims, 8 Drawing Sheets

COIN SORTING APPARATUS AND OPERATION METHOD OF THE SAME

FIELD OF THE INVENTION

The present invention relates to a coin sorting apparatus, and more particularly, to a coin sorting apparatus and an operating method of the same, capable of conveniently separating a lot of coins depending on kinds of the coins. In more particularly, the present invention relates to a coin sorting apparatus and an operating method of the same, in which a lot of coins can be separated during one-time operation, considering that coins received in one coin receiving tube is limited to a predetermined amount.

BACKGROUND OF THE INVENTION

Coins are products having relative small monetary valuation. In addition to cash, the coins are commonly used in economic markets. Specifically, the coins are made of metal and their sizes are distinguishable. Therefore, users can easily distinguish the coins. A coin sorting apparatus is a device that can easily separate the coins, considering that sizes of the coins are different from one another depending on values of the coins. Specifically, a large amount of money can be obtained at a time by separating coins collected in a child's moneybox. Therefore, the coin sorting apparatus is spread in almost every home so as to enhance a propensity to save.

Meanwhile, a general coin sorting apparatus is divided into a coin separating unit for separating coins depending on sizes of the coins, and a coin receiving unit for receiving the separated coins depending on their sizes. According to a general coin sorting apparatus, coin receiving tubes are formed depending on sizes of the coins, and the coins dropping downward are deposited in the coin receiving tubes having predetermined diameters. After the coins are full up to a predetermined height of the coin receiving tube, the user can pull out the deposited coins and evaluate the total values of the separated coins.

If one coin receiving tube is provided, the coin sorting apparatus cannot be used any more if a total amount of coins receivable in one coin receiving tube is full. Therefore, the operation of the coin sorting apparatus must be ended until a new coin receiving tube is mounted. In other words, if one of the coin receiving tubes formed depending on the kinds of the coins is full, the coin sorting apparatus cannot be operated until the full coin receiving tube is replaced.

Of course, a total amount of coins receivable in one coin receiving tube can increase by making the coin receiving tube high. However, in this case, there occurs a problem in that the size of the coin sorting apparatus also increases as much.

BRIEF SUMMARY OF THE INVENTION

Accordingly, the present invention is directed to a coin sorting apparatus that substantially obviates one or more problems due to limitations and disadvantages of the related art. An object of the present invention is to provide a coin sorting apparatus that can automatically receive more coins in other empty coin receiving tubes after one coin receiving tube is full. Another object of the present invention is to provide a coin sorting apparatus capable of improving a user's convenience by increasing a total amount of coins that can be separated in one-time operation.

A further another object of the present invention is to provide a coin sorting apparatus that can continuously operate without removing a full coin receiving tube.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a coin sorting apparatus includes: a control unit for controlling an operation of the coin sorting apparatus; a carrier container driving unit for separating inserted coins depending on sizes of the coins; a coin sensing unit for sensing the coins separated by the carrier container driving unit and transferring a sensing signal to the control unit; and a receiving tube driving unit for moving a new coin receiving tube so as to receive coins in an empty coin receiving tube, if the control unit judges that the coins are separated as many as the number of coins that are receivable in one coin receiving tube.

According to another aspect of the present invention, a coin sorting apparatus includes: a coin separating unit for separating coins depending on kinds of the coins; at least two coin receiving tubes arranged to receive the coins separated at the coin separating unit; a receiving container for supporting the coin receiving tubes; racks contacting with one side of the receiving tubes so as to move the receiving container; and a pinion for applying a torque to the racks.

According to a further another aspect of the present invention, a coin sorting apparatus includes: a coin separating unit for separating coins depending on kinds of the coins; various kinds of coin receiving tubes for receiving the coins separated at the coin separating unit; a plurality of receiving containers formed depending on the kinds of the coin receiving tubes, for the coin receiving tubes; a plurality of racks connected to the receiving containers; a plurality of pinions for selectively applying a torque to the plurality of racks; driving gears engaged with the pinions and connected to a motor; and gear receiving frames for allowing the pinions to be engaged with the driving gears so as to revolve the pinions with respect to the driving gears.

According to a further another aspect of the present invention, an operating method of a coin sorting apparatus includes the steps of: counting the number of separated coins depending on kinds of the coins; if the number of the separated coins reaches the number of coins receivable in one coin receiving tube, automatically moving an empty coin receiving tube and receiving coins in the empty coin receiving tube; and if all available receiving tubes are used, ending an operation of the coin sorting apparatus.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
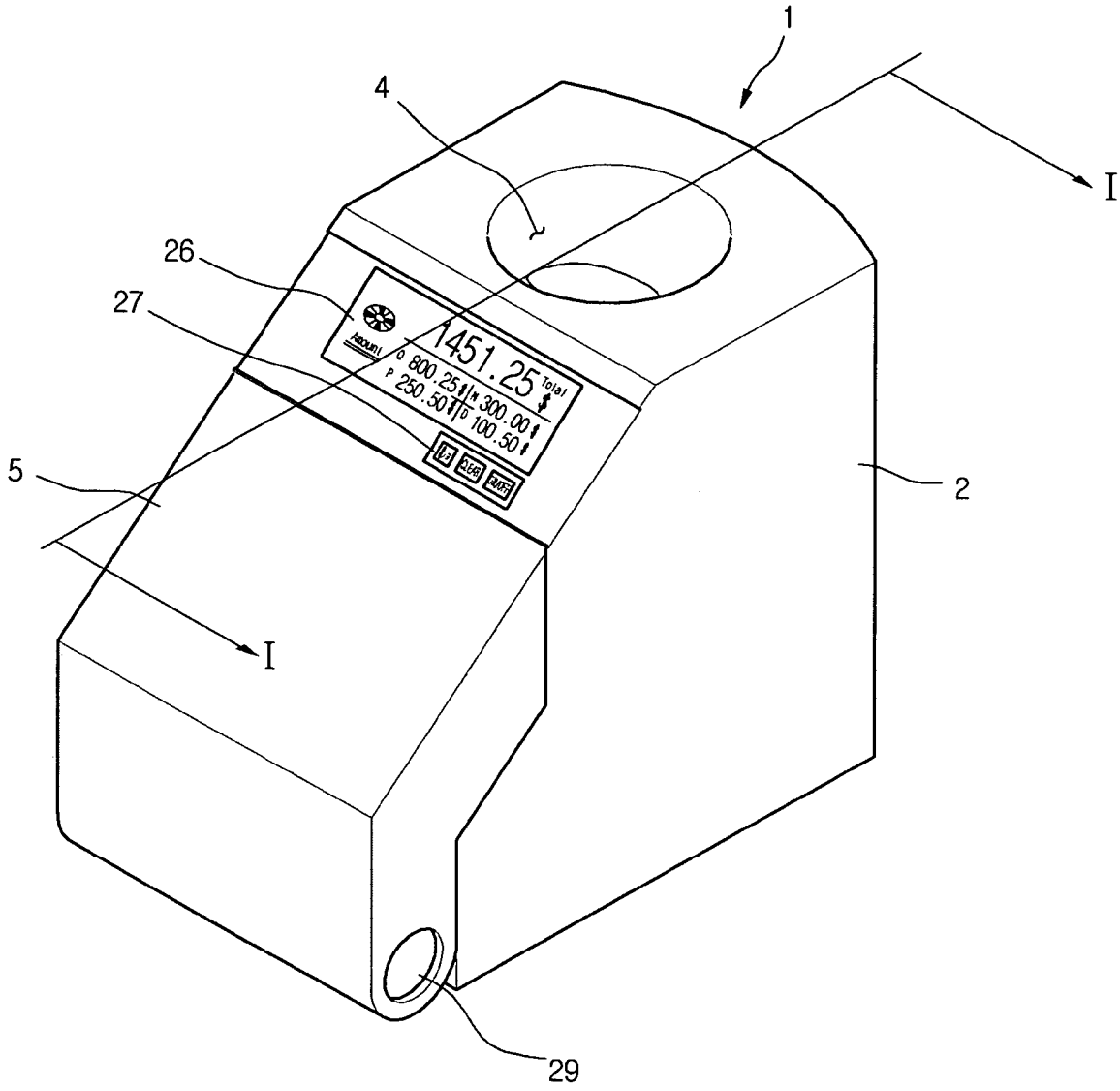
FIG. 1 is perspective view of a coin sorting apparatus according to the present invention.

FIG. 1 is a perspective view of a coin sorting apparatus according to the present invention.

Referring to FIG. 1, a coin sorting apparatus 1 according to the present invention includes an outer case 2 forming an outer appearance, a coin hopper 4 formed at an upper portion, a display part 26 formed at a front portion to display an operation state, a manipulation part 27 allowing a user to manipulate an operation start/stop of the coin sorting apparatus, and an operation cover 5 formed at a front portion and opening/closing around a hinge 29.

When the user wants to manipulate the coin sorting apparatus, the coin sorting apparatus begins to operate in a state that the operation cover 5 is opened. When the operation cover 5 is in an opened state, the operation cover 5 collects coins that are not received in a coin receiving part, such that the coins can be again separated. Also, the coin sorting apparatus 1 includes a coin-receiving-tube supporter 20 for supporting the operation cover 5 against the weight of coin receiving part when the opened operation cover 5 is entirely filled with coins.

Figure 2:
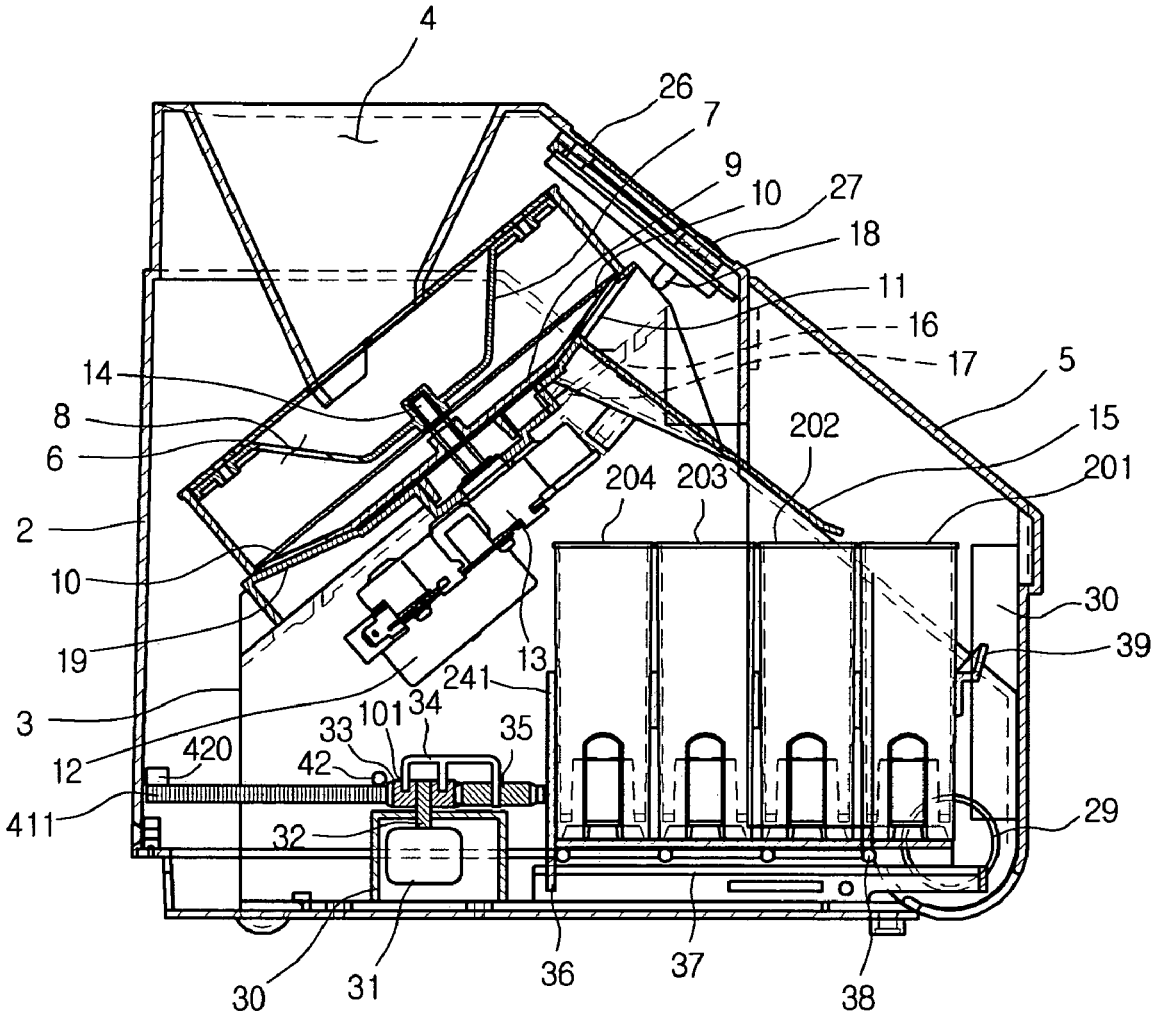
FIG. 2 is a sectional view taken along line I-I' of FIG. 1.

FIG. 2 is a sectional view taken along line I-I' of FIG. 1.

Referring to FIG. 2, the coin sorting apparatus includes a coin separating unit for separating coins depending on kinds of the coins, and a coin receiving unit for receiving the coins depending on the kinds of the coins separated by the coin separating unit.

The coin separating unit includes a feed controlling container 7, a control cover 6, a carrier container 9, a receiving part 19, and a dropping guide 15. The feed controlling container 7 temporarily stores the coins inserted through the hopper 4 and feeds the coins by a predetermined amount. The control cover 6 is formed at an upper portion of the feed controlling container 7 so as to prevent the coins from being released from the feed controlling container 7. The carrier container 9 contains the coins fed from the feed controlling container 7 by a predetermined amount and carries the coins one by one through a predetermined structure. The receiving part 19 receives the carrier container 9. The dropping guide 15 accurately drops the coins, which are separated through the receiving part 19 depending on the kinds, one by one.

Also, the coin sorting apparatus further includes a first motor 12 for rotating the carrier container 9 and the feed controlling container 7, and a gear part 13 for controlling a torque generated from the first motor 12 and transferring it.

In addition, the coin sorting apparatus further includes a feed opening 8, a carrier hole 10, and a separating hole 11. The feed opening 8 separately drops a predetermined amount of coins into the carrier container 9 by a rotation of the feed controlling container 7. The carrier hole 10 is formed at an outer periphery of the carrier container 9. The carrier hole 10 receives the coins one by one and transfers them upwards by the rotation of the carrier container 9. The separating hole 11 is formed at the receiving part 19. The separating hole 11 drops the coins to the dropping guide 15 so that the coins can be separated depending on their kinds. Specifically, one or more separating holes 11 having different sizes depending on their kinds are formed. In this embodiment, four separating holes 11 are formed so that four kinds of the coins can be separated. That is, four separating holes 11 can be formed on lower and upper sides with reference to FIG. 2. The number of the separating holes 11 is not limited to four; five separating holes can be formed.

Also, an inner case 3 is further formed so as to fix parts such as the receiving part 19 to an inside of the coin sorting apparatus.

In order to count the number of the separated coins, the coin sorting apparatus includes an opening 16 formed at a predetermined position of the dropping guide 15, and a light-emitting part 17 and a sensor 18 respectively formed at upper and lower sides of the opening 16. The light-emitting part 17 and the sensor 18 perform an operation of transmitting signals mutually. If the opening 16 is blocked by the coins dropping along the dropping guide 15, the signal transmittance between the light-emitting part 17 and the sensor 18 is interrupted such that the dropping of one coin can be determined. A total number and a total sum of the separated coins can be determined by the number of the dropping coins. Of course, the number of the opening 16 and related configuration may be multiple depending on the kinds of the coins.

An operation of the coin sorting apparatus will now be described with reference to the above configuration.

First, coins are put in the hopper 4. The coins are primarily contained in the feed controlling container 7. Only when the feed opening 8 is placed downward due to the rotation of the feed controlling container 7, the coins drop downward through the feed controlling container 7. Therefore, a predetermined amount of coins is intermittently dropped to the carrier container 9 through the feed controlling container 7. The feed controlling container 7 properly feeds the coins, such that the coins are separated without an accumulation in the carrier container 9 during the operation of the carrier container 9. Also, a total amount of the coins fed by the feed controlling container 7 can be controlled by adjusting a size of the feed opening 8.

The coins fed properly by the feed controlling container 7 are transferred upward in a state that the coins are received in the carrier holes 10 one by one. Since the carrier holes 10 are formed spaced apart from one another at the outer periphery of the carrier container 9, the coins put on the carrier holes 10 are transferred upward along the carrier holes 10. The carrier holes 10 may be formed by cutting or depressing the carrier container 9 of a predetermined thickness.

The coins transferred upward along the carrier holes 10 may be dropped to the dropping guide 15 in a state that the separating hole 11 and the carrier hole 10 are arranged in a row. In other words, various sizes of coins transferred along the carrier hole 10 are dropped downward through the separating holes 11 when a size of the coin coincides with that of the separating hole 11. If the separating hole 11 is small, a small coin is dropped downward, and if the separating hole 11 is large, a large coin is dropped downward. Of course, in order to separate the coins in turn, it is preferable that the separating holes 11 are sequentially formed depending on the sizes. For example, a small-sized separating hole 11 is formed at a position which is first arranged with the carrier hole 11, and a large-sized separating hole 11 is formed at a position which is later arranged with the carrier hole 10. In this manner, the small-sized coin can be first separated.

Also, in a state that the coins are guided by the dropping guide 15, the coins dropped through the separating holes 11 are dropped downward and received in the coin receiving part.

Meanwhile, the opening 16 is blocked one time by the coins that are dropped through the dropping guide 15. At this time, a transmitting state of light between the light-emitting part 17 and the sensor 18 is changed, so that the separation of the coins can be checked by the sensor 18. The separation of the coins sensed by the sensor 18 can be controlled by a controller and displayed on the display part 26. Of course, another control operation of the coin sorting apparatus can be guided.

The coin receiving unit will now be described in detail.

According to the present invention, a plurality of coin receiving tubes are arranged in a row in order to smoothly separate a large amount of coins. After one coin receiving tube is full of coins, a next coin receiving tube formed at a lower portion of the dropping guide 15 receives coins.

In more detail, the coin receiving unit includes a plurality of coin receiving tubes 201, 202, 203 and 204 for sequentially receiving the same kind of coins, receiving containers 241, 242, 243 and 244 for freely loading or unloading the coin receiving tubes, handgrips 39 formed at a right end portion of the receiving containers so that the user can move the receiving containers, a guide rail 37 formed at a lower side of the receiving container, and a receiving container guide part 36 formed at a lower side of the receiving containers 241, 242, 243 and 244. At least one portion of the receiving container guide part 36 guides is guided to the guide rail 37, so that the back-and-forth operation of the receiving container can be conveniently performed.

Also, in order to allow the receiving containers 241, 242, 243 and 244 to selectively operate back and forth, racks 411, 412, 413 and 414 are formed at left sides of the receiving containers with reference to the drawing, and pinions 35 are engaged with the racks. Also, driving gears 33 are engaged with the pinions 35 so as to provide a torque to the pinions 35. Gear receiving frames 34 fix the driving gears 33 and the pinions 35 to a predetermined position. A second motor 31 provides a torque to the driving gears 33. A gear central shaft 32 is inserted into a center of the driving gear 33 in a state that it is connected to a driving shaft of the second motor 31. A gear support bracket 30 supports the pinions 35 and fixes the second motor 31.

In detail, the gear receiving frames 34 and the driving gears are coupled in such a manner that one end of the gear receiving frame 34 is inserted in a groove 101 formed at a side of the driving gear 33. Also, the groove 101 has a circular shape about the center of the driving gear 33.

Therefore, the one end of the gear receiving frame 34 inserted into the driving gear 33 is slidably supported by the friction of the groove 101. The other end portion of the gear receiving frame 34 is inserted in a supported state by a predetermined frictional force in a state that it is slidable toward the center of the pinion 35. Due to this structure, when the driving gear 33 rotates, the gear receiving frame 34 can entirely rotate and the pinion 35 can also rotate in a state that it is engaged with the driving gear 33.

Further, a receiving tube sensing part 38 is formed to sense a movement of the receiving container. The receiving tube sensing part 38 is formed corresponding to the light-emitting part (40, in FIG. 3). In more detail, if light emitted from the light-emitting part 40 is sensed by the receiving tube sensing part 38, it is a normal state, that is, a state that the receiving tube is placed at an appropriate position. If not, it is a state that the receiving tube is not placed at a normal position. That is, the receiving tube needs to move. For this purpose, predetermined gap parts are formed at the coin receiving tubes and the receiving tubes so as to transmit the light.

In more detail, a plurality of coin receiving tubes 201, 202, 203 and 204 are formed depending on sizes of the coins. For example, if there are four kinds of the coins to be separated, four kinds of the coin receiving tubes are formed. If the kinds of the coins are more than four, more than four kinds of the coin receiving tubes have to be formed. Although the four coin receiving tubes having the same size are formed, other kinds of the coin receiving tubes may be further formed. The receiving containers 241, 242, 243 and 244 are individually formed depending on the kinds of the coin receiving tubes and thus can be selectively moved.

An operation of the coin receiving unit according to the present invention will now be described.

First, the coins guided and dropped by the dropping guide 15 are received in the first coin receiving tube 201. As a predetermined time elapses, the coins exceeds the capacity of the first coin receiving tube 201, and thus the new coin receiving tube must be placed down the dropping guide 15. At this time, the receiving containers 241, 242, 243 and 244 are pushed by the racks 411, 412, 413 and 414. Therefore, the first receiving tube 201 is pushed in a front direction and the second receiving tube 202 is placed down the dropping guide 15 to receive new coins.

Of course, the rack is operated due to the torque transferred through the second motor 31, the driving gear 33 and the pinion 35. This power transfer order will be described later. The new coin receiving tube, which is placed after one coin receiving tube is full, is automatically moved down the dropping guide 15. Therefore, the coin sorting apparatus can continuously operate without stopping until one kind of coin receiving tube is full.

Meanwhile, in a state that one coin receiving tube is full, when a total amount of the dropping coins is sensed, the total amount of the sensed coins is compared with the total number of the coins that can be received in one coin receiving tube. Only when the total amount is identical to the total number of the coins, it is determined that the coin receiving tube is full.

Also, the receiving container's movement due to the rack can be accurately performed by the receiving tube sensing part 38. In more detail, a state that the light emitted from the light-emitting part 40 is transmitted through the receiving tube and sensed by the receiving tube sensing part 38 disposed at the opposite side represents a state that the coin receiving tube is placed at a correct position. An operation of the second motor 31 is stopped to make the coin receiving tube placed at a correct position. A state that the light of the light-emitting part 40 is not sensed represents a state that the coin receiving tube is not placed at a correct position. That is, the coin receiving tube must be moved further.

Figure 3:
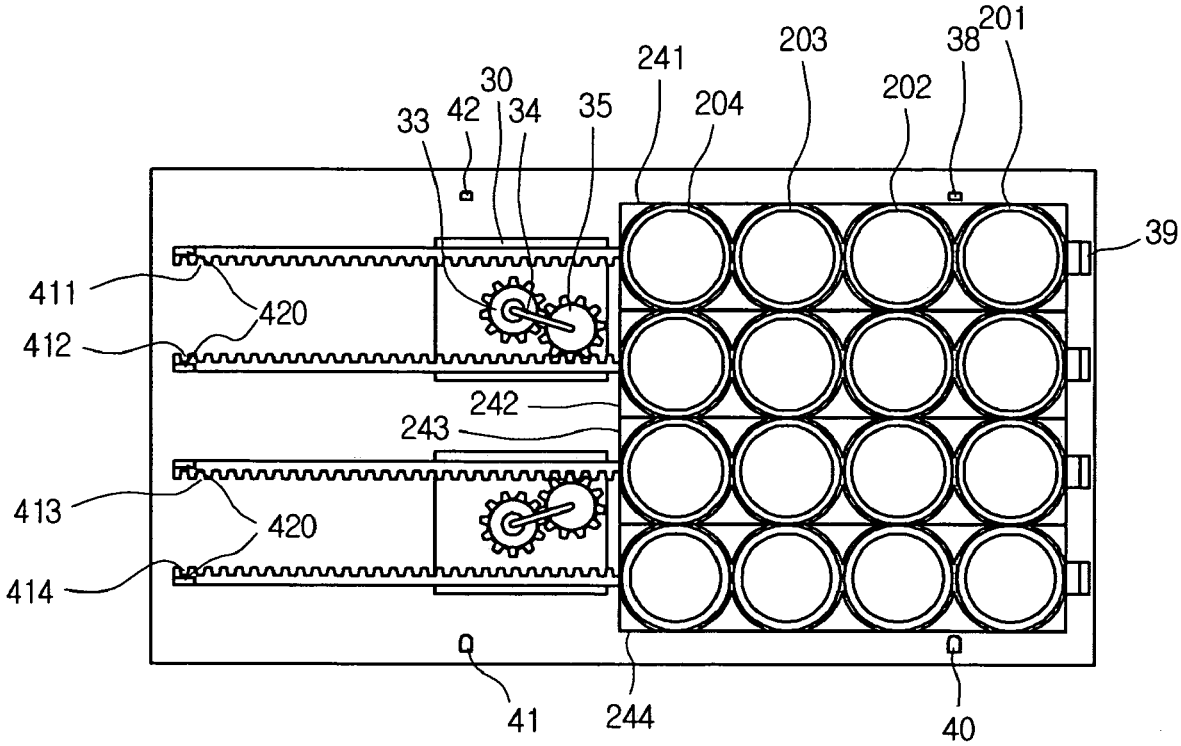
FIG. 3 is a plan view of a coin receiving unit according to the present invention.

FIG. 3 is a plan view of the coin receiving unit according to the present invention.

Referring to FIG. 3, the coin receiving unit includes the coin receiving tubes 201, 202, 203 and 204 and the receiving containers 241, 242, 243 and 244, the handgrips 39 of the receiving containers, the light-emitting part 40 for accurately sensing the movement position of the coin receiving tubes, and the receiving tube sensing part 38 for sensing the light of the light-emitting part 40. Four coin receiving tubes 201, 202, 203 and 204 are formed at every receiving containers 241, 242, 243 and 244. That is, a total of sixteen coin receiving tubes are formed. Of course, the number of the coin receiving tubes may be less than or more than four.

Also, the coin receiving unit includes the racks 411, 412, 413 and 414 for individually pushing the receiving containers 241, 242, 243 and 244, and the driving gears 33 and the pinions 35 for operating a specific rack. One driving gear 33 and one pinion 35 are formed at every one pair of the receiving containers.

Meanwhile, another light-emitting part 41 and another receiving container sensing part 42 are formed adjacent to the light-emitting part 40 and the receiving tube sensing part 38, respectively. The light-emitting part 41 and the receiving container sensing part 42 detect whether either of the receiving containers 241, 242, 243 and 244 are completely separated. The light emitted from the light-emitting part 41 is selectively sensed by the receiving container sensing part 42. For this purpose, it is preferable that the light-emitting part 41 is arranged with the receiving container sensing part 42.

In case the light emitted from the light-emitting part 41 is sensed by the receiving container sensing part 42, it represents a state that either of the receiving containers 241, 242, 243 and 244 is maximally pushed out so that they are not separated any more. An additional blocking part (not shown) is formed between the light-emitting part 41 and the receiving container sensing part 42 so as to selectively block the light emitted from the light-emitting part 41. An additional groove 420 in which the blocking part is not formed may be formed. The groove 420 can be formed at an innermost end of the racks 411, 412, 413, and 414. For different case, a separate groove (not shown) where the groove 420 is not formed may be formed. In that case, when light of the light-emitting part 41 is not sensed by the groove, the receiving container sensing part 42 can detect that the receiving container has been pushed out maximally. Of course, a groove used in an operation of the receiving tube sensing part 38 may be equally used. The groove may be formed at the innermost side of the receiving containers 241, 242, 243 and 244. In this manner, when the receiving containers 241, 242, 243 and 244 are maximally pushed out, this state can be sensed by the receiving container sensing part 42. Therefore, it is possible to make the receiving containers 241, 242, 243 and 244 not pushed any more.

This operation may occur in operating the coin sorting apparatus in a state that the user pulls out the receiving containers 241, 242, 243 and 244 by a predetermined length. For example, while the coins are newly deposited from the second receiving tube, the controller may judge that a certain coin receiving tube remains even when the coin receiving limit is reached, so that the coin sorting apparatus continuously operates. At this time, the motor and the gear may be damaged. In order to prevent the damage, the light-emitting part 41 and the receiving container sensing part 42 are formed.

Figure 4:
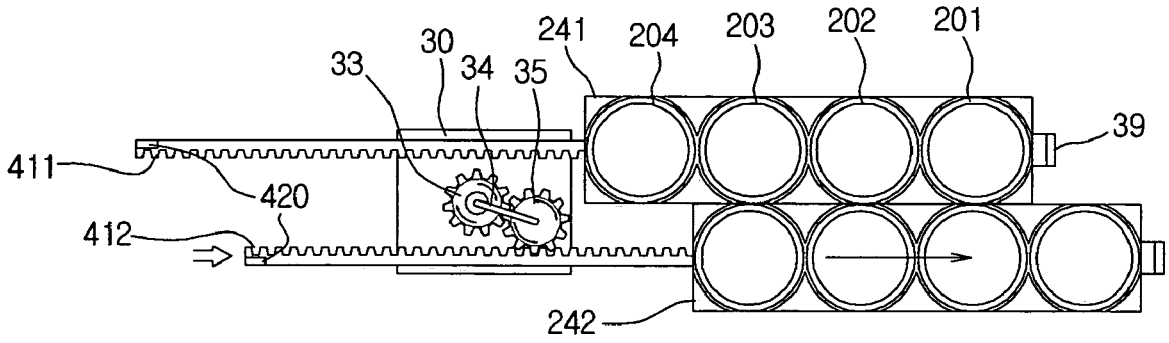
FIGS. 4 and 5 illustrate a state when a coin receiving tube is moved according to the present invention.
Figure 5:
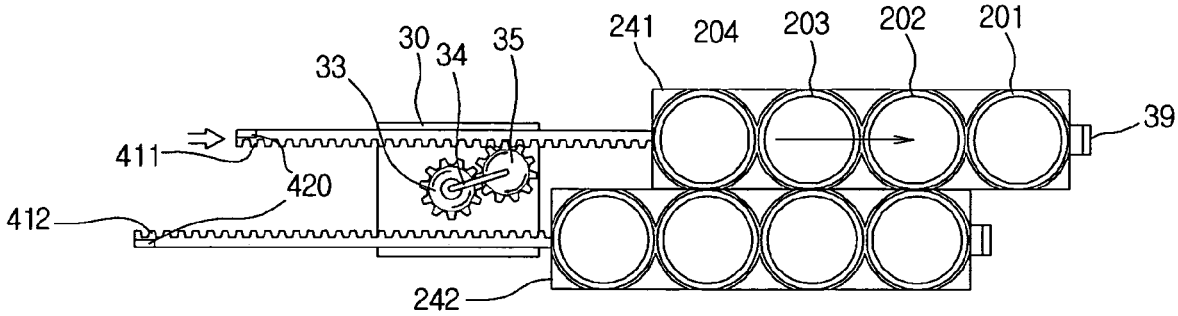

FIGS. 4 and 5 illustrate the states when the coin receiving tubes are moved according to the present invention. FIGS. 4 and 5 illustrate one pair of the receiving containers that are operated by one driving gear 33. Of course, another pair of the receiving containers may be formed. For the sake of convenience in explanation, only one pair of the receiving containers is depicted.

Referring to FIG. 4, a lower receiving container 242 needs to be moved and the first coin receiving tube 201 of the second receiving container 242 is in a full state. Of course, the state that the first coin receiving tube 201 is full of the coins may be sensed by the sensor 18 disposed adjacent to the dropping guide 15, and then it may be judged by the controller. At this time, after the first motor 12 stops and a coin sorting operation is temporarily suspended, the driving gear 33 rotates in a clockwise direction and the pinion 35 revolves in a clockwise direction in a state that it is guided by the gear receiving frame 34. The pinion 35 cannot revolve any more when it is engaged with the second rack 412. Therefore, the pinion 35 rotates in a counterclockwise direction to push the second rack 412 in a right direction, so that the coin receiving tube is pushed.

After the receiving container 242 is moved by a predetermined distance, that is, a length corresponding to a width of one coin receiving tube, it is sensed that the second coin receiving tube 202 is placed at a normal position due to the mutual operation of the light-emitting part 40 and the receiving tube sensing part 38. After the second coin receiving tube 202 is placed at the normal position in this manner, the rotation of the second motor 31 is stopped. Thus, in a state that the movement of the second coin receiving tube 202 is ended, coins are received at a new receiving container. Meanwhile, when one receiving container moves, other receiving containers have been already placed at normal positions. Therefore, only one receiving container which is moving is placed at the normal position. If a signal of the light-emitting part 40 is sensed by the receiving tube sensing part 38, it can be judged that the receiving container is placed at the normal position.

When the number of the dropping coins reaches the maximum number of coins that can be received in the coin receiving tubes, such a moving operation of the receiving container 412 is repeatedly performed until there are no empty coin receiving tubes. Of course, the operation of the coin sorting apparatus is ended until there are no empty coin receiving tubes. When the coin sorting operation is constantly performed due to moving time of the receiving container, coins may not be received in the receiving containers, thus the operation of the coin sorting apparatus can be stopped for a moment until the receiving container reaches the normal position so that the empty receiving tube can reach a lower side of the dropping guide because one coin receiving tube is full.

In case there is no possibility of dropping off coins because the moving time is short, the coin sorting operation may be performed constantly.

Also, in case all the coin receiving tubes are full, the coins are separated. Then, the user pushes the receiving container using the handgrip 39, such that the coin sorting apparatus again operates. In order to achieve the operation of smoothly pushing the coin sorting apparatus using the handgrip, the driving gear 33 is rotated in one direction one time and then in the opposite direction. By doing so, all the connection states of the rack and the pinion are released. Thus, when the user manually pushes the receiving container, the receiving container can be conveniently moved inwards.

Referring to FIG. 5, an upper receiving container 241 needs to be moved and the first coin receiving tube 201 of the second receiving container 242 is in a full state. Of course, the state that the first coin receiving tube 201 is full of the coins may be achieved sensed by the sensor 18 disposed adjacent to the dropping guide 15. At this time, the driving gear 33 rotates in a counterclockwise direction and the pinion 35 revolves in a counterclockwise direction in a state that it is guided by the gear receiving frame 34. The pinion 35 cannot revolve any more when it is engaged with the first rack 411. Therefore, the pinion 35 rotates in a clockwise direction to push the first rack 411 in a right direction, so that the position of the coin receiving tube is changed.

Since the operation of placing the second coin receiving tube 202 at the normal position and the operation of receiving the coins in the second coin receiving tube 202 are identical to those described in FIG. 4, their description will be omitted. The description in FIGS. 4 and 5 can be equally applied to all the coin receiving tubes of the coin sorting apparatus.

Figure 6:
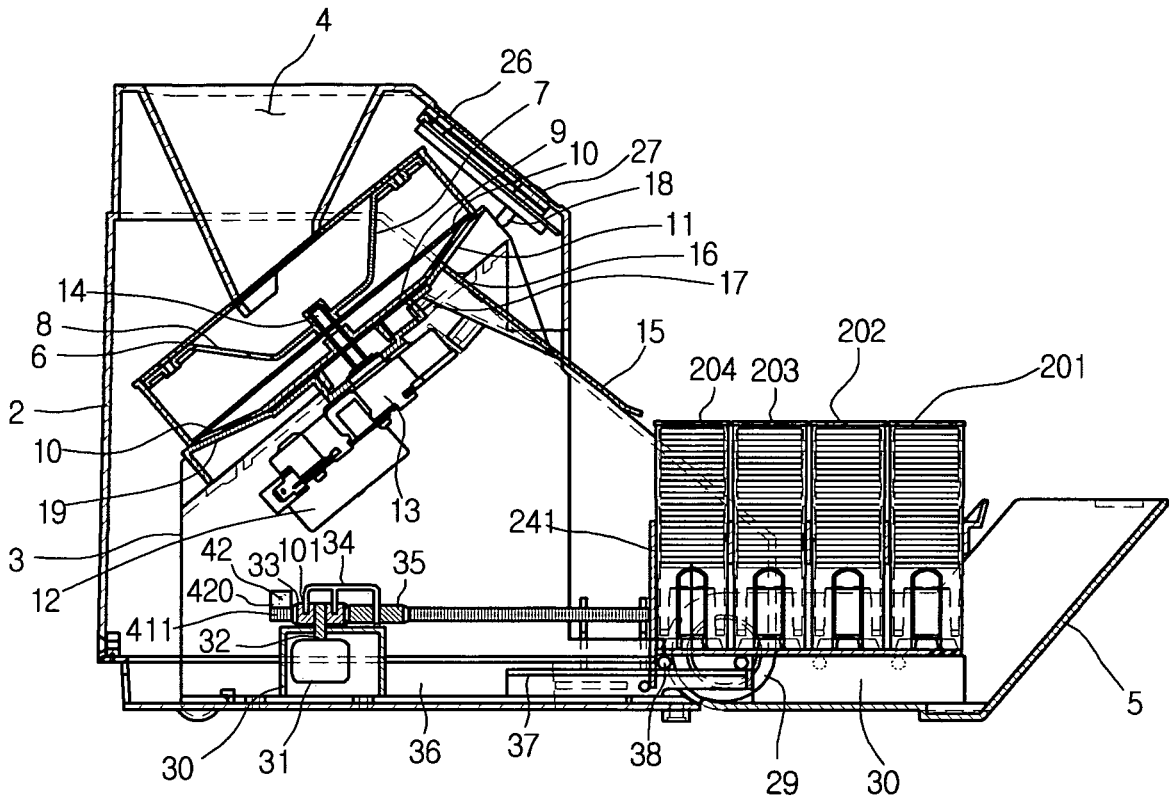
FIG. 6 illustrates a state that coins are fully received in all the coin receiving tubes.

FIG. 6 illustrates a state that coins are fully received in all the coin receiving tubes. At this time, the coin receiving tubes are entirely moved to a right direction with reference to the drawing, and all the coin receiving tubes are full of the coins. Also, the dropped coins are collected in the operation cover 5.

The coins received in the operation cover 5 can be filled, by a user, into a certain coin receiving tube that is not full.

Figure 7:
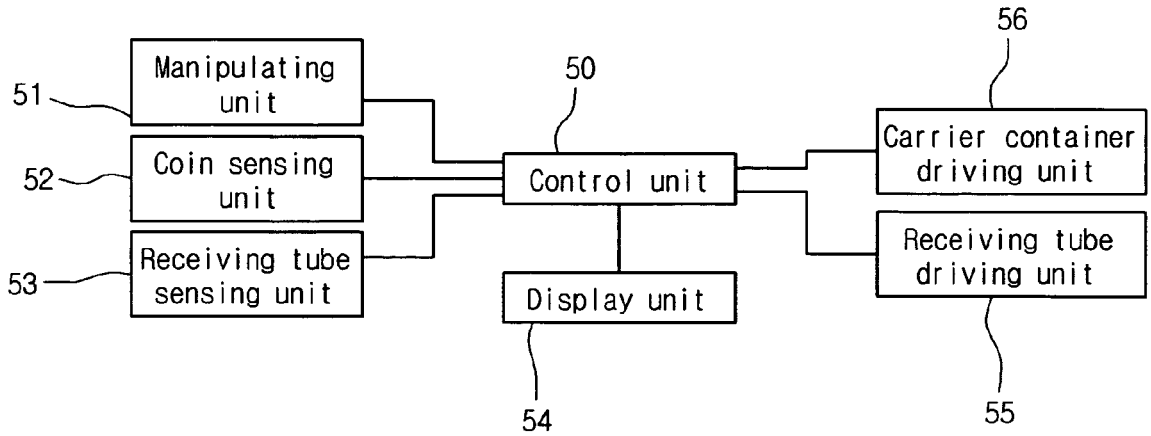
FIG. 7 is a block diagram of a coin sorting apparatus according to the present invention.

FIG. 7 is a block diagram of the coin sorting apparatus according to the present invention. The control operation of the coin sorting apparatus according to the present invention will now be described with reference to FIG. 7.

Referring to FIG. 7, the coin sorting apparatus according to the present invention includes a control unit 50, a manipulating unit 51, a coin sensing unit 52, a receiving tube sensing unit 53, a display unit 54, a receiving tube driving unit 55, and a carrier container driving unit 56. The control unit 50 controls an overall operation of the coin sorting apparatus. The manipulating unit 51 allows the user to instruct the manipulation, such as an on/off operation of the coin sorting apparatus. The coin sensing unit 52 senses the number of the coin dropped through the dropping guide 15 and transmits it the control unit 50. The receiving tube sensing unit 53 senses the movements of the receiving containers 241, 242, 243 and 244. The display unit 54 senses the operation state of the coin sorting apparatus and the total amount of the separated coins. The receiving tube driving unit 55 moves the receiving containers 241, 242, 243 and 244. The carrier container driving unit 56 drives the carrier container 9 to start the operation of the coin separating unit.

In more detail, the coin sensing unit 52 includes the opening 16, the light-emitting part 17 and the sensor 18 and performs a series of operations by means of this configuration. The receiving tube sensing part 53 includes the light-emitting part 40 and the receiving tube sensing part 38, and can further include another light-emitting part 41 and another receiving container sensing part 42, and performs a series of operations by means of this configuration. The receiving tube driving unit 55 includes the second motor 31, the driving gear 33, the gear receiving frame 34, the pinion 35, and the racks 411, 412 and 413 and performs a series of operations by means of this configuration. The carrier container driving unit 56 includes the first motor 12, the gear part 13, the carrier container 9 and the feed controlling container 7 and performs the operation of separating the coins by means of this configuration.

The operation of the coin sorting apparatus according to the present invention will be described in brief with reference to FIG. 7. If the coin sorting apparatus starts to be operated by the manipulating unit 51, the operation of separating the coins is started by the carrier container driving unit 56. During the separating operation, the coin sensing unit 52 senses the passage of the separated coins and the sensed passage is transmitted to the control unit 50 such that the total amount of the separated coins are counted. Then, the control unit 50 compares a total amount of coins separated through one dropping guide 15 with a total amount of coins that can be received in one coin receiving tube. If the coins reach the receivable amount of the coins, the carrier container driving unit 56 stops and the receiving tube driving unit 55 starts to operate.

When the receiving tube driving unit 55 operates, whether or not the receiving container reaches the normal position is continuously sensed by the receiving tube sensing unit 53. If the receiving container reaches the normal position, the operation of the receiving tube driving unit 55 is stopped. Of course, if it takes the receiving container a long time to reach the normal position, the carrier container driving unit 56 is temporarily stopped by the receiving tube driving tube 55. Thus, the operation of separating the coins is temporarily stopped until the coin receiving tube reaches the normal position, such that the coins can be prevented from being dropped and the coin sorting apparatus can normally operate for a long time. After the coin receiving tube reaches the normal position, the carrier container driving unit 56 continues to operate such that the operation of separating the coins can be continuously performed.

When all the coin receiving tubes are exhausted, the light-emitting part 41 and the receiving container sensing part 42 sense that all the receiving containers are exhausted, such that the operation of the receiving tube driving unit 55 and the carrier container driving unit 56 can be stopped.

Meanwhile, the display unit 54 displays in real time the total number of the separated coins and the total sum of the coins separated in a current state, thereby improving the user's convenience.

Figure 8:
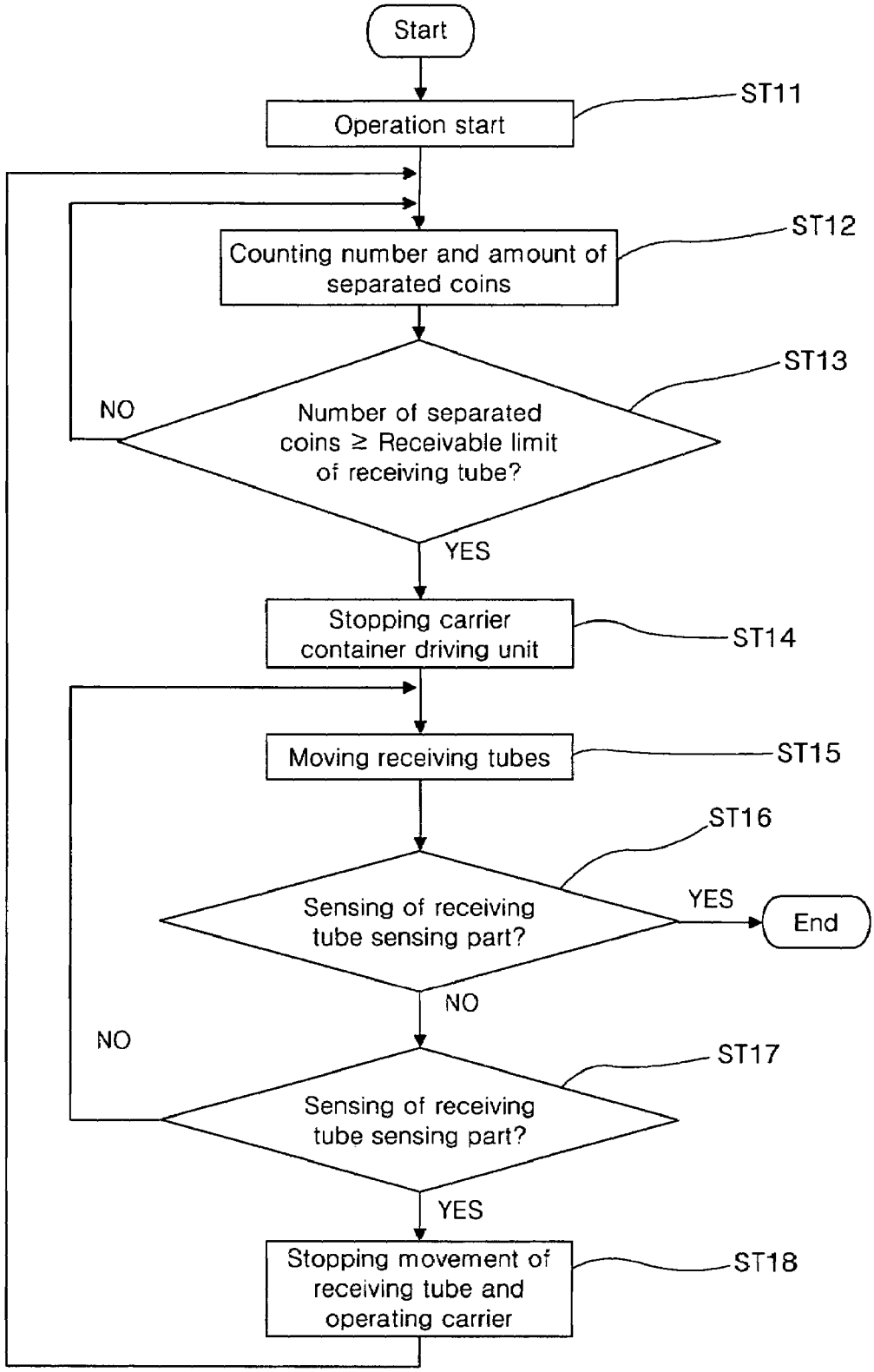
FIG. 8 is a flowchart illustrating an operating method of a coin sorting apparatus according to the present invention.

FIG. 8 is a flowchart illustrating an operating method of the coin sorting apparatus according to the present invention.

The operating method of the coin sorting apparatus according to the present invention will be described in detail with reference to FIG. 8. First, the operation of the coin sorting apparatus starts and the coins begins to be received in the respective coin receiving tubes (ST11). During the separating operation, the amount and sum of the separated coins and the total amount of the separated coins are continuously counted (ST12). Then, while the coins are continuously separated, a total number of coins separated in one coin receiving tube is compared with a receivable limit of the corresponding coin receiving tube. If the total number of the separated coins is less than the receivable limit, the separating operation is continuously performed. If the total number of the separated coins is equal to or more than the receivable limit, the process proceeds to a next step (ST13).

Meanwhile, if the total number of the separated coins reaches the receivable limit of the coin receiving tube, the carrier container driving unit is stopped (ST14) and then the coin receiving tube is moved (ST15). When the coin receiving tube is moving, whether or not the receiving container reaches the position where the receiving tube cannot be further slid out is sensed by the receiving tube sensing unit (ST16) such that the coin sorting apparatus is not further operated but is stopped, thereby preventing the coin sorting apparatus from being fractured.

When the receiving container is not sensed by the sensing unit, the sensing unit continues to sense whether or not the receiving container reaches the normal position (ST17). By doing so, if the receiving container does not reach the normal position, the receiving container moves continuously. If the receiving container reaches the normal position, the movement of the receiving tube is stopped (ST18).

The above-described method is continuously performed until there are no empty coin receiving tubes. In this manner, the coin sorting apparatus can be continuously operated until the coin receiving tubes are entirely filled.

Also, when the receiving container moves further in a state that the coin receiving tube is full, the receiving container sensing unit 42 senses that the receiving container is pulled out by a predetermined length. Therefore, the coin sorting apparatus is stopped without performing any operation, thereby preventing the damage of the coin sorting apparatus. This case may occur when the coin sorting apparatus starts to operate in a state that the user pulls out somewhat the coin receiving tube. The operation of the coin sorting apparatus is stopped in a state that all the coin receiving tubes are used up, thereby preventing the damage of the coin sorting apparatus. Of course, the operation of the coin sorting apparatus can be stopped by counting the received coins. As described above, the coin sorting apparatus of the present invention sequentially receives the coins in a plurality of coin receiving tubes, so that the coin sorting apparatus can operate for a longer time.

The present invention is not limited to the embodiments. That is, the coin sorting apparatus can be easily modified and other means for moving the coin receiving tubes can also be applied. Further, the empty coin receiving tubes are automatically moved and the full coin receiving tubes are replaced so that the empty coin receiving tubes are automatically moved down the dropping guide. In this manner, a plurality of coin receiving tubes can be sequentially used. Also, although four coin receiving tubes are sequentially used in the embodiments, more than four coin receiving tubes can also be used.

The present invention can increase the number of coins that can be separated during one-time operation of the coin sorting apparatus and can also lengthen a running time of the coin sorting apparatus.

Further, even when one coin receiving tube is completely full, the operation of the coin sorting apparatus can be continuously performed for a long time until all the coin receiving tubes of one kind are completely full without any manual operations for removing the full coin receiving tubes.

It will be apparent to those skilled in the art that various modifications and variations can be made in the present invention. Thus, it is intended that the present invention covers the modifications and variations of this invention provided they come within the scope of the appended claims and their equivalents.

We claim:

1. A coin sorting apparatus comprising:

a coin separating unit for separating coins depending on kinds of the coins;

a plurality of coin receiving tubes for receiving the separated coins;

a plurality of receiving containers for freely loading or unloading each of the plurality of coin receiving tubes;

two or more racks pushing one side of the receiving container so as to move the receiving container, and the racks contacting with the receiving container;

one driving gear and one pinion disposed at every one pair of the racks for applying a torque to the racks;

a gear receiving frame for connecting the driving gear and the pinion; and a motor for transferring a torque to the driving gear, wherein each of the plurality of receiving containers receives coin receiving tubes of the plurality of coin receiving tubes having the same size, and wherein each of the plurality of receiving containers moves the coin receiving tubes individually in the same direction; and wherein coin receiving tubes of the plurality of coin receiving tubes having the same size are placed at a plurality of positions according to movement of each of the plurality of receiving containers, and one of the coin receiving tubes having the same size receives the separated coins at each of the positions, wherein if the driving gear rotates in a counterclockwise direction, the pinion revolves in a counterclockwise direction as guided by the gear receiving frame and the pinion engages with one of the racks and rotates in a clockwise direction thereby moving that rack in a linear direction, and if the driving gear rotates in a clockwise direction, the pinion revolves in a clockwise direction as guided by the gear receiving frame and the pinion engages with the other of the racks and rotates in a counterclockwise direction thereby moving that other rack in a linear direction.

2. The coin sorting apparatus according to claim 1, wherein the gear receiving frame is respectively inserted into central portions of the pinion and the driving gear and supported by a predetermined frictional force.

3. The coin sorting apparatus according to claim 1, further comprising a bracket for supporting the pinion and fixing the motor.

4. The coin sorting apparatus according to claim 1, further comprising:

a receiving container guide part formed at one side of the receiving container; and a guide rail for supporting the receiving container guide part to guide a movement of the receiving container.

5. The coin sorting apparatus according to claim 1, further comprising a receiving tube sensing unit formed perpendicular to a movement direction of the coin receiving tube, for correctly instructing a movement of the coin receiving tube.

6. The coin sorting apparatus according to claim 1, further comprising a receiving container sensing unit for sensing a state that the receiving container is maximally moved and ending an operation of the coin sorting apparatus.

7. A coin sorting apparatus comprising:

a coin separating unit for separating coins depending on kinds of the coins;

various kinds of coin receiving tubes for receiving the coins separated at the coin separating unit;

a plurality of receivin containers for individually loading or unloading each of the coin receiving tubes;

a plurality of racks pushing one side of the receiving containers so as to move the receiving container, and the racks contacting with the receiving containers;

a plurality of pinions for selectively applying torque to the plurality of racks;

driving gears engaged with the pinions and connected to a motor; and gear receiving frames for allowing the pinions to be engaged with the driving gears so as to revolve the pinions with respect to the driving gears;

wherein each of the plurality of receiving containers receives the same kind of coin receiving tubes, and wherein each of the plurality of receiving containers moves the coin receiving tubes individually in the same direction; and wherein coin receiving tubes of each of the various kinds of coin receiving tubes are arranged in a line for receiving coins without movement until one of the coin receiving tubes in the line is full of the receivable number of the coins, and wherein one driving gear and one pinion are disposed at every one pair of the racks, and wherein if the driving gear rotates in a counterclockwise direction, the pinion revolves in a counterclockwise direction as guided by the gear receiving frame and the pinion engages with one of the racks and rotates in a clockwise direction, thereby moving that rack in a linear direction, and if the driving gear rotates in a clockwise direction, the pinion revolves in a clockwise direction as guided by the gear receiving frame and the pinion engages with the other of the racks and rotates in a counterclockwise direction thereby moving that other rack in a linear direction.

8. The coin sorting apparatus according to claim 7, wherein four or five kinds of the coin receiving tubes and the receiving containers are provided.

9. The coin sorting apparatus according to claim 7, wherein the receiving containers and/or the coin receiving tubes are formed at both a portion through which light is transmitted and a portion through which light is not transmitted.

10. The coin sorting apparatus according to claim 7, further comprising:

light-emitting unit; and a sensor for sensing light emitted from a light-emitting unit so as to sense a movement state of the receiving container.

* * * * *